US006945280B2

(12) United States Patent
Debaes

(10) Patent No.: US 6,945,280 B2
(45) Date of Patent: Sep. 20, 2005

(54) METHOD FOR WEAVING A PILE FABRIC

(75) Inventor: Johny Debaes, Moorslede (BE)

(73) Assignee: N. V. Michel Van de Wiele, Kortrijk/Marke (BE)

( * ) Notice: Subject to any disclaimer, the term of this patent is extended or adjusted under 35 U.S.C. 154(b) by 187 days.

(21) Appl. No.: 10/659,696

(22) Filed: Sep. 11, 2003

(65) Prior Publication Data

US 2004/0084101 A1 May 6, 2004

(30) Foreign Application Priority Data

Sep. 11, 2002 (BE) ..... 2002/0530

(51) Int. Cl.[7] ..... D03D 27/06

(52) U.S. Cl. ..... 139/21; 139/402; 139/37; 139/116.5; 139/404; 139/405

(58) Field of Search ..... 139/21, 37, 116.5, 139/404, 391, 397

(56) References Cited

U.S. PATENT DOCUMENTS

| | | | | |
|---|---|---|---|---|
| 2,329,739 A | | 9/1943 | Baker | |
| 3,014,502 A | * | 12/1961 | Valentine | 139/21 |
| 6,102,083 A | * | 8/2000 | Vandoorne | 139/391 |
| 6,186,186 B1 | * | 2/2001 | Debaes et al. | 139/21 |
| 6,273,148 B1 | * | 8/2001 | Debaes et al. | 139/402 |
| 6,343,626 B1 | * | 2/2002 | Demey et al. | 139/398 |
| 6,742,546 B2 | * | 6/2004 | Debaes et al. | 139/21 |
| 6,769,456 B2 | * | 8/2004 | Debaes et al. | 139/21 |

FOREIGN PATENT DOCUMENTS

| | | |
|---|---|---|
| EP | 0628649 | 12/1994 |
| EP | 0922799 | 6/1999 |
| EP | 1013804 | 6/2000 |
| EP | 1180556 | 2/2002 |

* cited by examiner

*Primary Examiner*—John J. Calvert
*Assistant Examiner*—Robert H. Muromoto
(74) *Attorney, Agent, or Firm*—James Creighton Wray; Meera P. Narasimhan

(57) ABSTRACT

The present invention relates to a method for weaving pile fabrics on a face-to-face weaving machine, where, in successive insertion cycles, weft yarns (1–12) are inserted between binding warp yarns (13–16) and pile warp yarns (17–24), so that two backing fabrics (30), (31) are woven one above the another, in which groups of at least four weft yarns (1–6); (7–12) are inserted in respective openings between repeatedly crossing binding warp yarns (13), (14); (15), (16), so that each group of weft yarns (1–6); (7–12) comprises at least two pairs of weft yarns (2,3), (5,6), (8,9), (11,12) inserted above one another, and so that pile warp yarns (18), (21), (24) are interlaced in the upper (30) and in the lower backing fabric (31) alternately round the weft yarns (2), (5), (8), (11), situated on the back, of the said pairs in order to form pile burls, preferably according to a two-shot weave;

The present invention likewise relates to pile fabric woven according to this method. Such pile fabrics have a good pile retention, an excellent quality of the back and a great flexibility and may be carried out at a high pile density.

23 Claims, 3 Drawing Sheets

METHOD FOR WEAVING A PILE FABRIC

This application claims the benefit of Belgian Application No. 2002/0530 filed Sep. 11, 2003.

BACKGROUND OF THE INVENTION

The present invention relates to a method for weaving pile fabrics on a face-to-face weaving machine, where, in successive insertion cycles, weft yarns are inserted between binding warp yarns and pile warp yarns, so that two backing fabrics are woven one above the other, in which groups of at least four weft yarns are inserted in respective openings between repeatedly crossing binding warp yarns, and so that pile warp yarns are interlaced over a weft yarn in the upper and lower backing fabric alternately in order to form pile burls.

This invention likewise relates to a pile fabric comprising a backing fabric in which groups of weft yarns are inserted in respective openings between repeatedly crossing binding warp yarns and pile burls bent round a weft yarn.

More particularly the present invention relates to a pile fabric such as, for instance, a carpet, having a high pile density as well as to a method for manufacturing such pile fabrics.

In order to weave carpets with a high pile density, the reed setting (the number of backing warp yarns per meter of width of the fabric) should be set at a high value, for instance, at 500 to 512 per meter on the one hand and a high weft density (the number of weft yarns per meter of length of the fabric) should be obtained, for instance, 8 to 10 per centimeter on the other hand, in order to obtain a sufficiently large number of pile rows per meter (high pile row density).

A method and a fabric having the properties mentioned above are known from the Belgian patent no 1 012 005 (patent application no 9,700,993). In order to be able to weave a fabric having a higher pile row density according to the productive two rapier weaving method, a weave is applied here, the binding warp yarns being crossed off each time in a group of four wefts, and the weft yarns of these groups each time being inserted in the backing fabric at three different levels. Because of this the weft yarns of each group will end up lying more or less above one another and a higher weft density and consequently also a higher pile row density will be obtained. With this method it is possible to manufacture carpets having a high weft density of 13.5 or 27 weft yarns per meter for instance.

However, the carpets obtained according to this method have the disadvantage that their quality could be better. Especially the flexibility, the quality of the back and the pile retention of these fabrics being capable of improvement.

SUMMARY OF THE INVENTION

The purpose of the present invention is to provide a method for weaving pile fabrics having the properties mentioned in the first section of this description, supplying pile fabrics with a high pile density for a better quality than the pile fabrics woven according to the known weaving methods. Moreover, the present invention aims at increasing still more the pile density of the pile fabrics thus woven.

This purpose is obtained by providing a method having the characteristics mentioned in the first section of this description, each time at least two weft yarns being inserted during the successive insertion cycles, so that each group of weft yarns comprises at least two pairs of weft yarns being inserted one above the other, and each time the pile warp yarns being interlaced over the weft yarns of these pairs situated on the back.

Because each time the pile warp yarns forming pile are interlaced over the weft yarns situated on the back, the pattern formed by the pile warp yarns becomes clearly visible on the back of the pile fabric, so that an excellent quality of the back is obtained. Because there are weft yarns situated at two different levels between the two pile tufts of each pile burl, the pile tufts will be well compressed, the consequence of which is good pile retention. Because of which, the quality of the pile fabrics will be improved.

This method may be carried out in such a manner that intermediate weft yarns may be provided between the successive pile burls, but may also, at will, be carried out without inserting intermediate weft yarns. Without intermediate weft yarns, the said pairs of weft yarns are the only weft yarns being provided per group. This allows for a very high weft density to be obtained, and therefore to weave fabrics having a very high pile density.

If however, intermediate weft yarns are indeed provided, a slightly lower pile density is obtained, but then the pile tufts are flanked by a weft yarn on either side, so that they are better kept in an upright position and a higher pile retention is obtained.

With the method according to the present invention, preferably a pair of weft yarns for the upper backing fabric and a pair of weft yarns for the lower backing fabric are inserted alternately during the successive insertion cycles.

Preferably, the pile forming pile warp yarns are made to form pile burls according to a two-shot weave.

If with this method, in each backing fabric co-operating binding warp yarns are provided, which each time are crossing one another after at least four successive insertion cycles, a high pile row density is made possible on the one hand, but especially also a pile fabric is obtained having a great flexibility. The larger the number of successive working cycles between the successive crossings of the binding warp yarns, the greater the flexibility of the fabric.

Furthermore, this method is preferably carried out such that in at least one backing fabric pile warp yarns forming no pile are woven in, which are situated between the two weft yarns of each pair of weft yarns, each time one weft yarn of which is situated on the back and the other on the pile face of the fabric. Because of which, these pile warp yarns forming no pile are covered both on the pile side and on the back and the inconvenient effect on the aspect of the pile fabric is avoided. By providing intermediate weft yarns between the successive pile burls, these pile warp yarns forming no pile are even better protected on one of the two faces. For instance, these intermediate weft yarns may extend on the back with respect to the weft yarns forming no pile and therefore increase the quality of the back of the fabric.

Preferably, when carrying out this method, also in at least one backing fabric both tension warp yarns and pile warp yarns forming no pile will be woven in, whereas the two weft yarns of each pair of weft yarns are provided on the back and on the pile face with respect to these tension warp yarns and of these pile warp yarns forming no pile respectively.

In a very preferred method according to the present invention each time three weft yarns are inserted during the successive insertion cycles and of which two weft yarns are inserted in the upper and the lower backing fabric alternately, whereas each time the third weft yarn is inserted in the other backing fabric. This method may be carried out in a very productive manner on a three rapier weaving machine, by means of which three weft yarns are inserted simultaneously in each insertion cycle. Then the said third weft yarn preferably becomes a weft yarn situated between the successive pile burls, a number of advantages of which were mentioned already above.

With this method, two weft yarns may be inserted during a number of insertion cycles, and three weft yarns may be inserted during a number of other insertion cycles, two weft yarns of which are inserted in the one backing fabric, whereas the third weft yarn is interlaced in the other backing fabric, so that each group of weft yarns comprises at least one third weft yarn.

By leaving out a number of third weft yarns situated between the pile burls, a higher pile row density may be obtained than in the case where an intermediate weft yarn is provided between all successive pile burls.

Preferably, the weaving machine comprises weft insertion means being provided in order to insert three weft yarns per insertion cycle, whereas by carrying out this method during the insertion cycle in which two weft yarns are inserted, either one weft insertion means is disconnected or no weft yarn is presented to one weft insertion means.

The method according to the present invention may also be carried out such, that in at least one backing fabric the pile warp yarns forming no pile are woven in and the said third weft yarns are provided on the back of these woven in pile warp yarns. These third weft yarns then provide the additional cover on the back of this woven in pile warp yarns forming no pile, resulting in a better quality of the back of the fabric.

Also a number of tension warp yarns may be provided in at least one backing fabric and the said third weft yarns may be provided between the tension warp yarns on the one hand and the woven in pile warp yarns forming no pile on the other hand. Because of which the third weft yarns are inserted at a level, which is situated between the levels of the weft yarns situated above one another. Because the pile tufts then extend between two weft yarns running above one another at a first and a second level on the one hand, and a weft yarn at a third level between this first and second level on the other hand, a very good pile retention and pile tufts well kept in an upright position are obtained.

Furthermore the pile warp yarns forming no pile are woven in in these backing fabrics preferably distributed among both backing fabrics.

In a most preferred method according to the present invention, preferably, in each group of weft yarns two pairs of weft yarns are provided, inserted above one another, and the pile warp yarns forming pile are interlaced according to a two-shot weave round the weft yarns of each pair situated on the back.

The present invention further also relates to a pile fabric, comprising a backing fabric in which groups of weft yarns have been inserted in respective openings between repeatedly crossing binding warp yarns and pile burls bent round a weft yarn,—according to the present invention—each group of weft yarns of which comprises at least two pairs of weft yarns inserted above one another and the pile burls are bent round the weft yarns of these pairs situated on the back.

Because the pile burls are bent round the weft yarns situated on the back, the back of such a pile fabric is of an excellent quality. Because between the pile tufts, each time a pair of weft yarns situated at different levels are running, the pile tufts are well compressed and this fabric has a very good pile retention.

The pile fabric according to the present invention preferably comprises pile warp yarns forming no pile, woven in in the backing fabric, whereas the two weft yarns of each pair of weft yarns are provided on the back and on the pile face of these pile warp yarns forming no pile respectively.

Because of this the pile warp yarns forming no pile are well covered on either side and their inconvenient effect on the aspect of the fabric is avoided.

In the backing fabric of the pile fabric according to the invention both tension warp yarns may be provided and pile warp yarns forming no pile may be woven in, whereas the two weft yarns of each pair of weft yarns are running on the back and on the pile face of these tension warp yarns and pile warp yarns forming no pile respectively.

In the backing fabric, preferably two weft yarns are inserted above one another and one weft yarn is separately inserted alternately. In a very preferred pile fabric according to the present invention, each group of weft yarns comprises two pairs of weft yarns inserted above one another and one or two weft yarns inserted separately.

In order to obtain a high pile row density, the pile fabric is preferably carried out such that in each group of weft yarns the number of weft yarns inserted separately is smaller than the number of pairs of weft yarns inserted above one another.

In a preferred embodiment of the pile fabric, pile warp yarns forming no pile are woven in in the backing fabric and the said weft yarns inserted separately are provided on the back with respect to these woven in pile warp yarns. Because of which the weft yarns forming no pile are even better covered on the back of the fabric.

In yet another embodiment, a number of tension warp yarns are provided in the backing fabric and pile warp yarns forming no pile are woven in, and the said weft yarns inserted separately are provided between the tension warp yarns on the one hand and the pile warp yarns forming no pile on the other hand. Because of which the weft yarns inserted separately are inserted at a level situated between the levels of the weft yarns of the said pairs inserted above one another. Therefore these weft yarns inserted separately and the weft yarns running below one another, each at a respective level, may run closer next to one another and even may be running more or less below one another, because of which the weft density may be increased.

A very preferred pile fabric is obtained when pile burls are formed round the weft yarns of each pair of weft yarns situated on the back.

In the following detailed description, the method and the pile fabric according to the present invention are described in more detail on the basis of a number of embodiments. The only purpose of this description is to further explain the principles and said characteristics and advantages of the invention by means of a number of concrete examples. It may be obvious that nothing in this description therefore may be interpreted as a restriction of the scope of the patent rights set forth in the claims, nor as a limitation of the field of application of this invention.

In the following description, by means of reference numbers, reference is made to the attached drawings which each time are illustrating a method by representing a partly schematic cross-section in the warp direction of an upper and a lower carpet during their production on a face-to-face weaving machine, in which

DETAILED DESCRIPTION OF THE PREFERRED EMBODIMENTS

Figure 1:
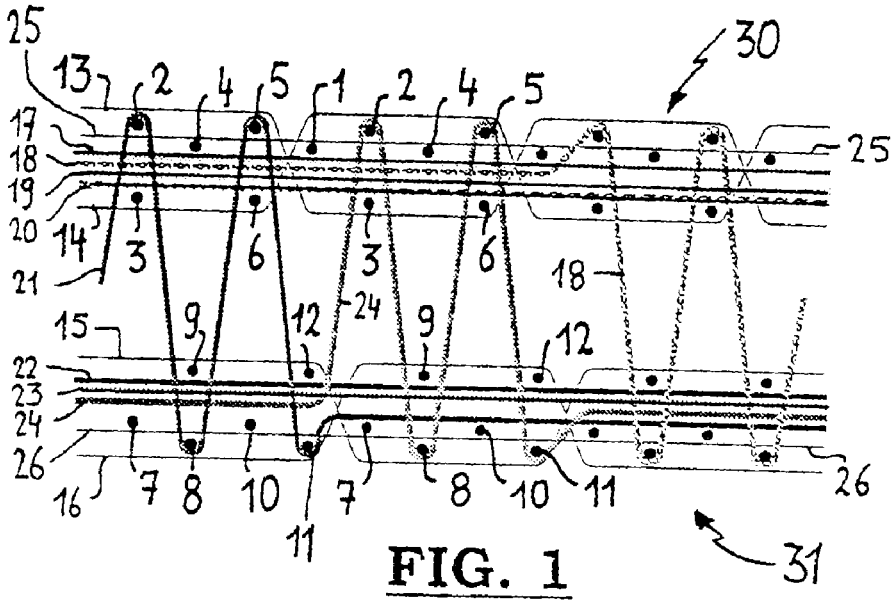
FIG. 1 is illustrating a method in which during successive weft insertion cycles, each time three weft yarns are inserted above one another, so that two weft yarns one above the other and one single weft yarn are inserted both in the upper and in the lower fabric alternately.
Figure 2:
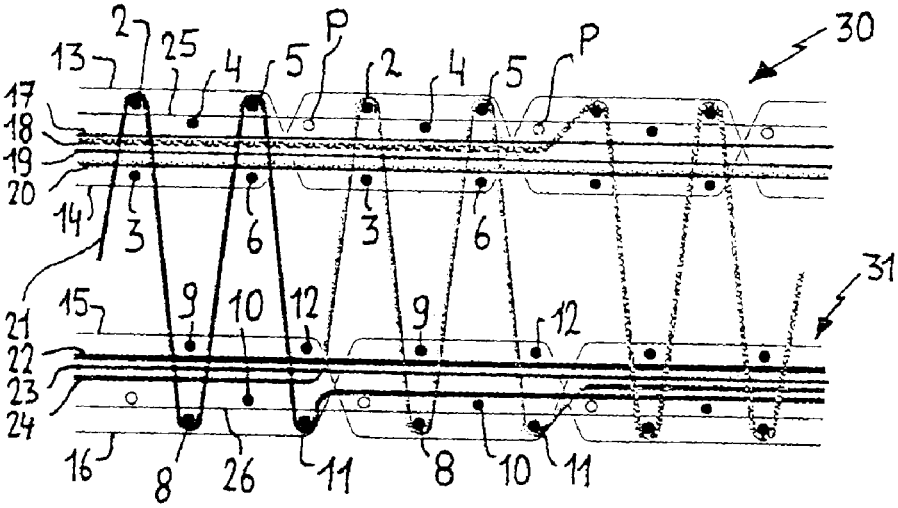
FIGS. 2 and 3 are illustrating two methods which are different from the method of FIG. 1 in that now, during certain weft insertion cycles, two weft yarns are inserted and three weft yarns are inserted in other insertion cycles.
Figure 2:
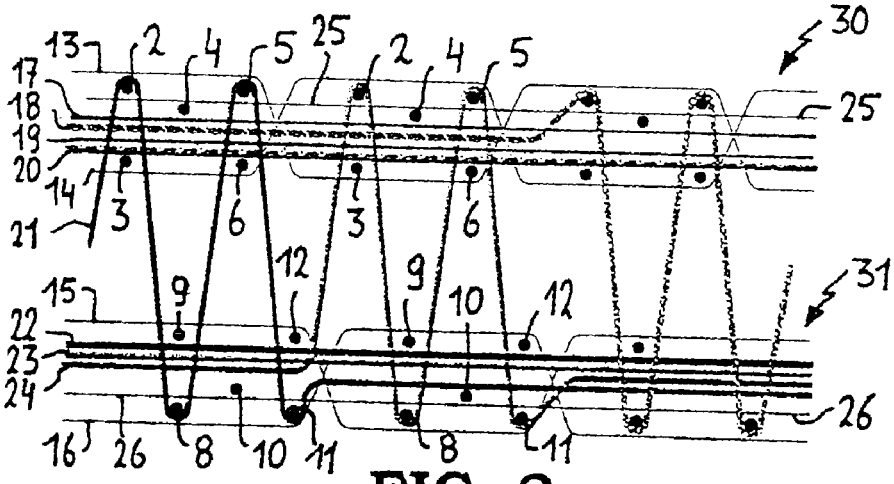
Figure 3:
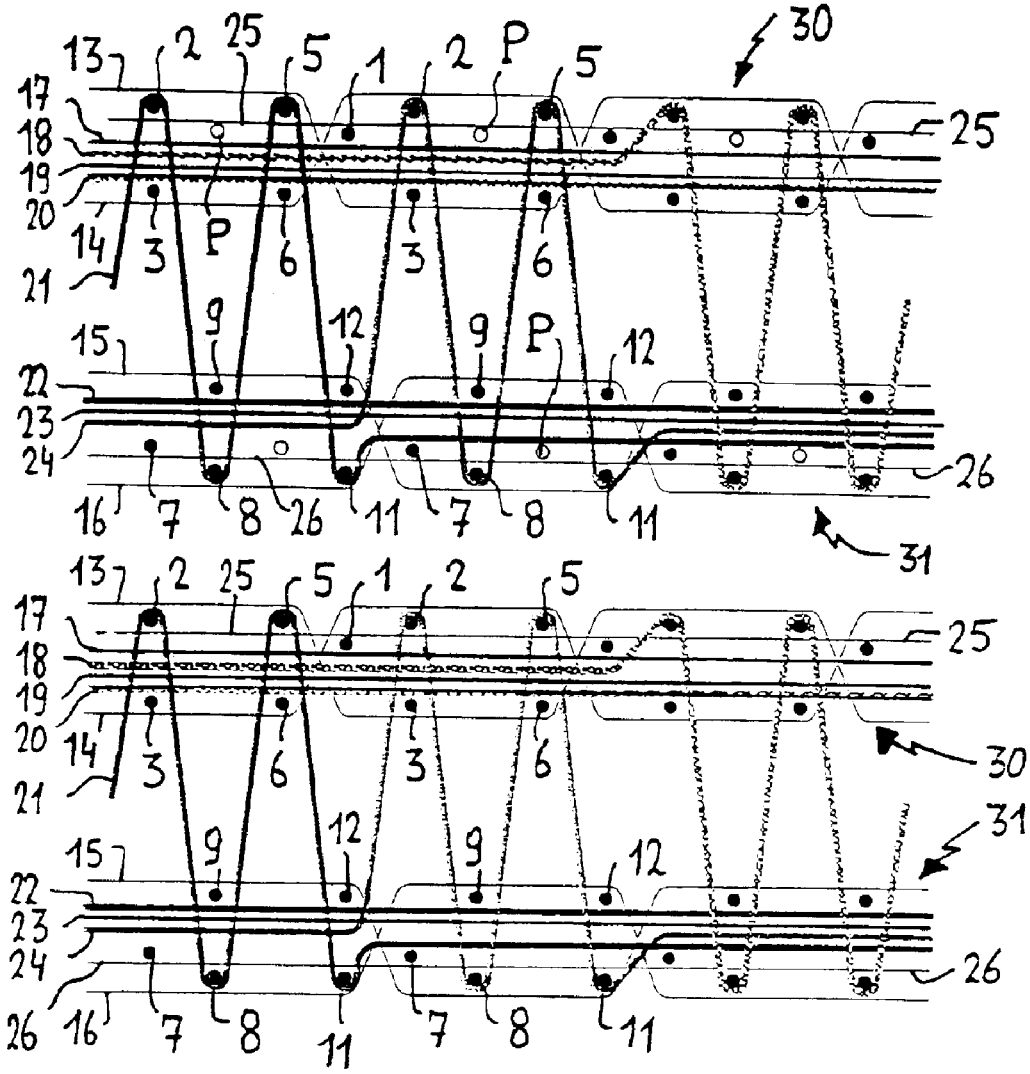
Figure 4:
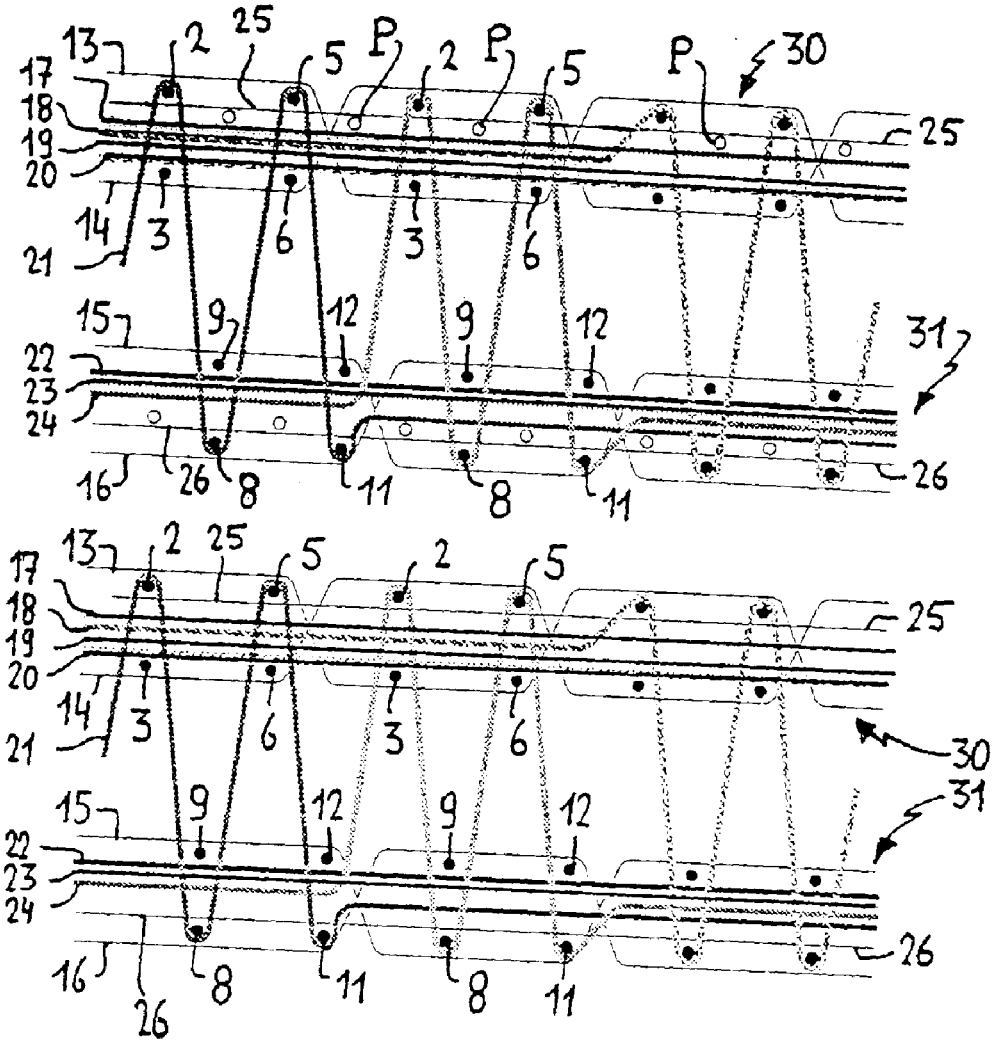
FIG. 4 is illustrating a method, which is different from the method of FIG. 1 in that now two weft yarns one above the other are inserted in all weft insertion cycles, so that each time two weft yarns are inserted one above the other in the upper and in the lower fabric alternately.

The FIGS. 2, 3 and 4 each comprise an upper and a lower cross-section of the face-to-face carpet fabric which are only different from one another in that in the upper cross-section each time, by means of little circles (P) is indicated in which places a weft yarn is left out with respect to the method according to FIG. 1.

According to a first preferred method according to the present invention (see FIG. 1) binding warp yarns (13–16), pile warp yarns (17–24) and tension warp yarns (25,26) are provided on a three rapier face-to-face weaving machine. This occurs with a high reed setting of, for instance, 512 per meter. The weaving machine is designed to insert each time three weft yarns (2, 3,7), (4,9,8), (5,6,10), (1,12,11) simultaneously above one another during successive weft insertion cycles in sheds formed between these warp yarns (13–26). In these sheds, in each cycle, the warp yarns (13–26) are brought at the exact heights with respect to the insertion levels of the weft yarn (1–12) rapiers, by means of known shed forming means, so that the binding warp yarns (13–16) and the weft yarns (1–12) will form an upper (30) and a lower backing fabric (31), whereas pile warp yarns (21), (24), (18) forming pile are interlaced over a weft yarn (2), (5) of the upper backing fabric (30) and over a weft yarn (8), (11) of the lower backing fabric (31) alternately in order to form pile burls according to a predetermined drawing or pattern and whereas the tension warp yarns (25), (26) and pile warp yarns (17–24) forming no pile are woven in in both backing fabrics (30), (31).

Of the three weft yarns (2,3,7), (4,9,8), (5,6,10), (1,12,11) which are inserted during successive insertion cycles, two weft yarns (2,3), (5,6) are inserted in the upper backing fabric (30) and two weft yarns (9,8), (12,11) in the lower backing fabric (31) alternately, whereas the third weft yarn (1), (7), (4), (10) is inserted each time in the other backing fabric. In this manner, in each backing fabric (30), (31) two weft yarns (2,3), (5,6); (9,8), (12,11) one above the other, and one intermediate weft yarn (1), (4); (7), (10) are inserted alternately.

In each backing fabric (30), (31), sets of two co-operating binding warp yarns (13,14), (15,16) are provided. These co-operating binding warp yarns (13,14), (15,16) are crossing one another repeatedly, so that successive openings are formed between their successive intersections and between the binding warp yarns (13,14), (15,16) running above one another. Through each opening, a group of weft yarns (1–6), (7–12) extend, because of which these weft yarns are interlaced by the binding warp yarns in the backing fabric (30), (31) concerned. Each group of weft yarns (1–6), (7–12) successively comprises, in order of insertion, one single weft yarn (1), (7), two weft yarns (2,3), (9,8) inserted simultaneously one above the other, one intermediate weft yarn (4), (10), and finally two other weft yarns (5), (6); (12), (11) inserted simultaneously above one another. The tension warp yarns (25), (26) are woven in in the backing fabrics (30), (31) and are running each time between the two weft yarns (2,3), (5,6); (9,8), (12,11) inserted simultaneously one above the other and on the back with respect to the intermediate weft yarns (1), (4); (7), (10). The pile warp yarns (17–24) forming no pile are woven in in the backing fabrics (30), (31), distributed among both backing fabrics and are running between the weft yarns (2,3), (5,6); (9,8), (12,11) inserted simultaneously one above the other and on the pile face with respect to the intermediate weft yarns (1), (4); (7), (10). These intermediate weft yarns are therefore running between the tension warp yarns (25), (26) and the woven in pile warp yarns (17–24) and because of this, are interlaced at a level situated between the levels of the weft yarns (2,3), (5,6); (9,8), (12,11) inserted one above the other. Because of which the 6 weft yarns (1–6), (7–12) of each group will situate themselves per three weft yarns (2,3,4), (5,6,1); (7,8,9), (10,11,12) more or less above one another when they are compressed, because of which a high weft density is obtained.

The pile warp yarns (18), (21), (24) forming pile are each time interlaced over a weft yarn (2), (5), (8), (11) which is situated on the back of the carpet concerned with respect to the interlaced pile warp yarns (17–24) and tension warp yarns (25), (26). Weaving through in such a manner, at the level of the pile warp yarns (18), (21), (24) forming pile at the level of each pile burl ensures that the pattern formed by the pile burls will be very clearly visible on the back of the carpets. The pile warp yarns forming no pile (17–24) are well covered on the back by both the weft yarn (2), (5), (8), (11) running on the back of each pair of weft yarns inserted simultaneously and the intermediate weft yarns (1), (4); (7), (10). This also will be an important contribution to the good quality of the back of the carpets.

Because the binding warp yarns (13,14), (15,16) are crossed off only after four successive insertion cycles, carpets having a great flexibility are obtained. It is obvious that also backing weaves are possible where the binding warp yarns (13,14), (15,16) are crossed off each time after more than four insertion cycles. Each pile tuft is situated between two weft yarns (2,3), (5,6), (9,8), (12,11) inserted above one another on the one hand and one weft yarn (1), (4); (7), (10) inserted at an intermediate level on the other hand, so that carpets having an excellent pile retention and pile tufts being well kept in an upright position are obtained.

The method illustrated in FIG. 2 is different from the method described above with reference to FIG. 1 in that in a number of weft insertion cycles, only two weft yarns (11,12), (2,3) are inserted by disconnecting one of the three rapiers or by not supplying it with a weft yarn.

With the method according to FIG. 2 there are two successive insertion cycles alternately in which three weft yarns (4,9,8), (5,6,10) are inserted above one another and two insertion cycles during which only two weft yarns (11,12), (2,3) are inserted above one another. During the successive insertion cycles, two weft yarns (2,3), (9,8), (5,6), (11,12) are inserted in the upper (30) and the lower backing fabric (31) alternately, whereas the third weft yarn (4), (10), if there is one, is inserted each time in the other backing fabric. As may be seen clearly in FIG. 2, each group of weft yarns (1–6), (7–12) now comprises two pairs of weft yarns (2,3), (5,6), (9,8), (11,12) inserted above one another and one intermediate weft yarn (4), (10) situated between the two pairs.

According to another method, which is illustrated in FIG. 3, only two weft yarns (8,9), (5,6) are likewise inserted in a number of weft insertion cycles, whereas in other insertion cycles three weft yarns (2,3,7), (1,12,11) are inserted together. This is also done here by disconnecting one of the three rapiers or by not supplying it with a weft yarn.

During the successive insertion cycles with this method also two weft yarns (2,3), (9,8), (5,6), (11,12) are inserted in the upper (30) and the lower backing fabric (31) alternately, whereas the third weft yarn (1), (7), if there is one, is inserted in the other backing fabric each time. Each group of weft yarns (1–6), (7–12) likewise comprises two pairs of weft yarns (2,3), (5,6); (9,8), (11,12) inserted above one another and one intermediate weft yarn (1), (7). The difference with respect to the method according to FIG. 2 is that in each group of weft yarns (1–6), (7–12)—in the successive openings between binding warp yarns (13,14), (15,16)—the intermediate weft yarn (1), (7) is now the weft yarn first inserted, and therefore is not situated between the two pairs of weft yarns (2,3), (5,6); (9,8), (11,12) of the group (as in FIG. 2).

By leaving out half of the intermediate weft yarns (with respect to the method according to FIG. 1), in the places (P) indicated, the methods according to FIGS. 2 and 3 produce carpets having a higher pile density and pile tufts which are better compressed. Obviously it is possible with these methods to make the binding warp yarns (13,14), (14,15) also cross each time after more than four machine cycles.

The pile density of the carpets may be further increased, with respect to the method according to FIG. 1, by leaving out all intermediate weft yarns (1), (4), (7), (10) by weft canceling or disconnecting a rapier. This is the method according to FIG. 4. Moreover, because of this, the pile tufts are also very well compressed. With this method also, the binding warp yarns (13,14), (15,16) may be made to cross each time after more than four insertion cycles.

What is claimed is:

1. Method for weaving pile fabrics on a face-to-face weaving machine, where, in successive insertion cycles, weft yarns (1–12) are inserted between binding warp yarns (13–16) and pile warp yarns (17–24), so that two backing fabrics (30), (31) are woven one above the another, in which groups of at least four weft yarns (1–6); (7–12) are inserted in respective openings between repeatedly crossing binding warp yarns (13), (14); (15), (16), and so that pile warp yarns (18), (21), (24) are interlaced over a weft yarn (2), (5), (8), (11) in the upper (30) and lower backing fabric (31) alternately in order to form pile burls, wherein during the successive insertion cycles each time at least two weft yarns (1,11,12), (2,3,7), (4,8,9), (5,6,10) are inserted, so that each group of weft yarns (1–6); (7–12) comprises at least two pairs of weft yarns (2,3), (5,6), (8,9), (11,12), being inserted one above the other and in that the pile warp yarns (18), (21), (24) are interlaced each time over the weft yarns (2), (5), (8), (11) of these pairs, situated on the back.

2. Method according to claim 1, wherein during the successive insertion cycles a pair of weft yarns (2,3), (5,6) is inserted for the upper backing fabric (30) and a pair of weft yarns (8,9), (11,12) for the lower backing fabric (31).

3. Method according to claim 1, wherein the pile warp yarns (18), (21), (24) forming pile are made to form pile burls according to a two-shot weave.

4. Method according to claim 1, wherein in each backing fabric (30), (31) co-operating binding warp yarns (13), (14); (15), (16) are provided, which are crossing one another each time after at least four successive insertion cycles.

5. Method according to claim 1, wherein in at least one backing fabric (30), (31) pile warp yarns (17–24) forming no pile are woven in, and in that the two weft yarns of each pair of weft yarns (2,3), (5,6), (8,9), (11,12) are provided on the back and on the pile face of these pile warp yarns (17–24) forming no pile respectively.

6. Method according to claim 1, wherein in at least one backing fabric (30), (31) tension warp yarns (25), (26) are provided and pile warp yarns (17–24) forming no pile are woven in, and in that the two weft yarns of each pair of weft yarns (2,3), (5,6), (8,9), (11,12) are provided on the back and on the pile face of these pile warp yarns (17–24) forming no pile.

7. Method according to claim 1, wherein during the successive insertion cycles each time three weft yarns (1,11,12), (2,3,7), (4,8,9), (5,6,10), (1,11,12) are inserted and in that two of them (2,3), (8,9) (5,6), (11,12) are inserted in the upper (30) and in the lower backing fabric (31) alternately, whereas each time the third weft yarn (7), (4), (10), (1) is inserted in the other backing fabric.

8. Method according to claim 1, wherein during a number of insertion cycles two weft yarns (2,3), (11,12) are inserted, and in that during a number of other insertion cycles three weft yarns (4,8,9), (5,6,10) are inserted, two of which weft yarns (8,9), (5,6) are inserted in the one backing fabric whereas the third weft yarn (4), (10) is inserted in the other backing fabric, so that each group of weft yarns (1–6), (7–12) also comprises at least one third weft yarn (1), (4), (7), (10).

9. Method according to claim 1, wherein the weaving machine comprises weft insertion means, which are provided to insert three weft yarns (1,11,12), (2,3,7), (4,8,9), (5,6,10), (1,11,12) per insertion cycle, and in that during the insertion cycle in which two warp yarns (2,3), (8,9), (5,6), (11,12) are inserted, either one weft insertion means is disconnected, or no weft yarn is presented to one of the weft insertion means.

10. Method according to claim 7, wherein in at least one backing fabric (30), (31) pile warp yarns (17–24) forming no pile are woven in, and in that the said third weft yarns (7), (4), (10), (1) are provided on the back of these interlaced pile warp yarns.

11. Method according to claim 7, wherein in at least one backing fabric (30), (31) a number of tension warp yarns (25), (26) are provided, and in that the said third tension warp yarns (7), (4), (10), (1) are provided between the tension warp yarns (25), (26) on the one hand and the woven in pile warp yarns (17–24) forming no pile on the other hand.

12. Method according to claim 1, wherein pile warp yarns (17–24) forming no pile, distributed among the two backing fabrics, are woven in in these backing fabrics.

13. Method according to claim 1, wherein in each group of weft yarns (1–6), (7–12) two pairs of weft yarns (2,3), (5,6), (8,9), (11,12), inserted above one another, are provided, and in that the pile warp yarns (18), (21), (24) are interlaced according to a two-shot weave round the weft yarns (2), (5), (8), (11), situated on the back, of each pair.

14. Pile fabric comprising a backing fabric (30), (31) in which groups of weft yarns (1–6), (7–12) are inserted in respective openings between repeatedly crossing binding warp yarns (13), (14); (15), (16) and pile burls interlaced over a weft yarn (2), (5); (8), (11), wherein each group of weft yarns (1–6), (7–12) comprises at least two pairs of weft yarns (2,3), (5,6); (8,9), (11,12) inserted one above the other, and in that the pile burls are interlaced over the weft yarns (2), (5); (8), (11) situated on the back, of these pairs.

15. Pile fabric according to claim 14, wherein pile warp yarns (17–24) forming no pile are woven in in the backing fabric (30), (31), and in that the two weft yarns of each pair of weft yarns (2,3), (5,6): (8,9), (11,12) are provided on the back and on the pile face of these pile warp yarns (17–24) forming no pile.

16. Pile fabric according to claim 14 wherein tension warp yarns (25), (26) are provided and in that pile warp yarns (17–24) forming no pile are woven in in the backing fabric (30), (31), and in that the two weft yarns of each pair of weft yarns (2,3), (5,6); (8,9), (11,12) are running on the back and on the pile face of these tension warp yarns (25), (26) and pile warp yarns (17–24) forming no pile respectively.

17. Pile fabric according to claim 14, wherein two weft yarns (2,3), (5,6); (8,9), (11,12) inserted above one another and one weft yarn (1), (4); (7), (10) inserted separately are inserted alternately in the backing fabric (30), (31).

18. Pile fabric according to claim 14, wherein each group of weft yarns (1–6), (7–12) comprises two pairs of weft yarns (2,3), (5,6); (8,9), (11,12) inserted above one another and one weft yarn (1), (4); (7), (10) inserted separately.

19. Pile fabric according to claim 14, wherein each group of weft yarns comprises two pairs of weft yarns (1–6), (7–12) inserted above one another and two weft yarns (1), (4); (7), (10) inserted separately.

20. Pile fabric according to claim 14, wherein in each group of weft yarns (1–6), (7–12) the number of weft yarns (1), (4), (7), (10) inserted separately is less than the number of pairs of weft yarns (1–6), (7–12) inserted above one another.

21. Pile fabric according to claim 14, wherein pile warp yarns (17–24) forming no pile are woven in in the backing fabric, and in that the said weft yarns (1), (4); (7), (10) inserted separately are provided on the back of these woven in pile warp yarns (17–24).

22. Pile fabric according to claim 14, wherein a number of tension warp yarns (25), (26) are provided and pile warp yarns (17–24) forming no pile are woven in in the backing fabric, and in that the said weft yarns (1), (4); (7), (10) inserted separately are provided between the tension warp yarns (25), (26) on the one hand and the pile warp yarns (17–24) forming no pile on the other hand.

23. Pile fabric according to claim 1, wherein pile burls are interlaced over the weft yarns (2), (5; (8), (11) of each pair of weft yarns (2,3), (5,6); (8,9), (11,12) situated on the back.

* * * * *